US007146671B2

(12) United States Patent
Kim et al.

(10) Patent No.: US 7,146,671 B2
(45) Date of Patent: Dec. 12, 2006

(54) METHOD OF CONTROLLING WASHING MACHINE

(75) Inventors: Hyun-sook Kim, Seoul (KR); Hyung-kyoon Kim, Suwon (KR); Sang-yeon Pyo, Suwon (KR); Chan-woo Park, Anyang (KR); Myung-gyu Lee, Suwon (KR); Seon-woo Park, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 480 days.

(21) Appl. No.: 10/216,430

(22) Filed: Aug. 12, 2002

(65) Prior Publication Data

US 2003/0154559 A1 Aug. 21, 2003

(30) Foreign Application Priority Data

Feb. 20, 2002 (KR) ..... 2002-8935

(51) Int. Cl.
*D06F 39/04* (2006.01)

(52) U.S. Cl. ..... 8/159; 68/12.04; 68/12.05; 68/12.19

(58) Field of Classification Search ..... 68/12.04, 68/12.05, 12.19; 8/158, 159
See application file for complete search history.

(56) References Cited

U.S. PATENT DOCUMENTS

| | | | | |
|---|---|---|---|---|
| 1,741,191 | A | | 12/1929 | Kirby |
| 2,145,453 | A | | 1/1939 | Miller |
| 2,145,454 | A | | 1/1939 | Miller |
| 2,509,264 | A | | 5/1950 | Cox |
| 2,645,111 | A | | 7/1953 | Fields |
| 2,695,510 | A | | 11/1954 | Clark |
| 2,715,826 | A | | 8/1955 | Kirby |
| 2,831,333 | A | | 4/1958 | Smith |
| 2,902,851 | A | | 9/1959 | Fields |
| 2,902,852 | A | | 9/1959 | Fields |
| 2,921,460 | A | | 1/1960 | Aberle |
| 2,931,201 | A | | 4/1960 | Hubbard |
| 2,948,128 | A | | 8/1960 | Smith |
| 3,091,953 | A | | 6/1963 | Hubbard |
| 3,102,408 | A | | 9/1963 | Pelensky |
| 3,102,410 | A | | 9/1963 | Doyle |
| 3,290,908 | A | | 12/1966 | McAllister et al. |
| 3,412,621 | A | | 11/1968 | Jacobs |
| 4,321,809 | A | * | 3/1982 | Bochan ..... 68/207 |
| 4,428,088 | A | * | 1/1984 | Getz et al. ..... 8/158 |
| 4,489,574 | A | * | 12/1984 | Spendel ..... 68/16 |
| 4,779,430 | A | * | 10/1988 | Thuruta et al. ..... 68/12.04 |

(Continued)

FOREIGN PATENT DOCUMENTS

EP 0 883 004 4/1998

(Continued)

OTHER PUBLICATIONS

U.S. Appl. No. 10/197,332, filed Jul. 18, 2002, Kim et al.
U.S. Appl. No. 10/216,238, filed Aug. 12, 2002, Pyo et al.

*Primary Examiner*—Frankie L. Stinson
(74) *Attorney, Agent, or Firm*—Staas & Halsey LLP

(57) ABSTRACT

A method of controlling a washing machine having a wobbling device. The wobbling device is switched to a leveling position to operate a spin-drying tub and a washboard and to a wobbling position to operate the washboard. The control method of the washing machine includes the steps of detecting the load of laundry, supplying water through a plurality of stages if the detected load of laundry is lighter than a predetermined reference load, and operating a pulsator in each of the stages through which water is supplied.

15 Claims, 9 Drawing Sheets

U.S. PATENT DOCUMENTS 4,862,710 A * 9/1989 Torita et al. ..... 68/12.01
5,000,015 A * 3/1991 Nakamura et al. ..... 68/23.3
5,144,819 A * 9/1992 Hiyama et al. ..... 68/12.04
5,297,307 A * 3/1994 Baek ..... 8/159
5,353,612 A 10/1994 Noguchi et al.
5,460,018 A 10/1995 Werner et al.
5,504,955 A 4/1996 Mueller et al.
5,507,053 A 4/1996 Mueller et al.
5,737,790 A * 4/1998 Badger et al. ..... 8/158
5,743,115 A * 4/1998 Hashimoto ..... 68/12.12
5,768,728 A 6/1998 Harwood et al.
5,791,167 A 8/1998 Wyatt et al.
5,943,885 A * 8/1999 Park ..... 68/53
5,946,949 A 9/1999 Park et al.
6,070,439 A 6/2000 Jung
6,115,863 A 9/2000 Mason et al.
6,227,013 B1 5/2001 Wyatt-Smith
6,460,381 B1 * 10/2002 Yoshida et al. ..... 68/12.04
6,557,382 B1 * 5/2003 Koike et al. ..... 68/17 R
6,986,271 B1 1/2006 Kim et al.

FOREIGN PATENT DOCUMENTS

JP 64-22286 1/1989
JP 7-31786 * 2/1995

* cited by examiner

METHOD OF CONTROLLING WASHING MACHINE

BACKGROUND OF THE INVENTION

1. Field of the Invention

The present invention relates generally to a washing machine, and more particularly to a method of controlling a washing machine, which supplies water to the washing machine according to the amount of laundry load, thereby improving the washing performance of the washing machine.

2. Description of the Prior Art

FIG. 1 is a flowchart showing a conventional method of controlling a washing machine.

Referring to FIG. 1, in the conventional washing machine control method, in order to wash a load of laundry, a user sets washing conditions through an input unit at step S10. In this case, the user can set the washing conditions by an automatic mode provided in the input unit or by manually inputting a particular washing mode.

When the setting of washing conditions is completed, water is supplied at step S20, and the water level of the tub is detected at step S30. Thereafter, it is determined whether the water level detected at step S30 has reached the level set at step S10.

If as the result of the determination at step S40 the water level of the tub has reached the set water level, water supply is stopped at step S50. Thereafter, the washing of the laundry is performed at step S60. The washing of step S60 may include a washing process, a rinsing process and a spin-drying process.

In the conventional washing machine control method, once a water level is set, water is supplied according to the set water level without regard to the amount of laundry load, so laundry may not be uniformly wetted at the early stage of washing when the load is relatively heavy. This may result in inefficient and/or incomplete washing and/or rinsing processes. Moreover, the uneven wetting of the laundry may result in the uneven distribution of the laundry causing an unbalance, which may result in noises and/or vibration in the spin-drying process.

SUMMARY OF THE INVENTION

Accordingly, the present invention has been made keeping in mind the above problems occurring in the prior art, and an object of the present invention is to provide a method of controlling a washing machine, which supplies water to the washing machine according to the amount of laundry load, thereby improving the washing performance of the washing machine.

In order to accomplish the above object, the present invention provides a method of controlling a washing machine, comprising: detecting a load of laundry; determining a basic water supply level commensurate with said detected load; and supplying said basic water supply level through a plurality of stages, a corresponding apportionment of said basic water supply level being supplied during each respective ones of said plurality of stages.

In addition, the present invention provides a method of controlling a washing machine having a wobbling device, the wobbling device being switched to a leveling position to operate a spin-drying tub and a washboard and to a wobbling position to operate the washboard, comprising: detecting a load of laundry; determining a basic water supply level commensurate with said detected load; and supplying said basic water supply level through a plurality of stages, a corresponding apportionment of said basic water supply level being supplied during each respective ones of said plurality of stages, wherein said wobbling device is switched to said wobbling position during least one of said plurality of stages.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
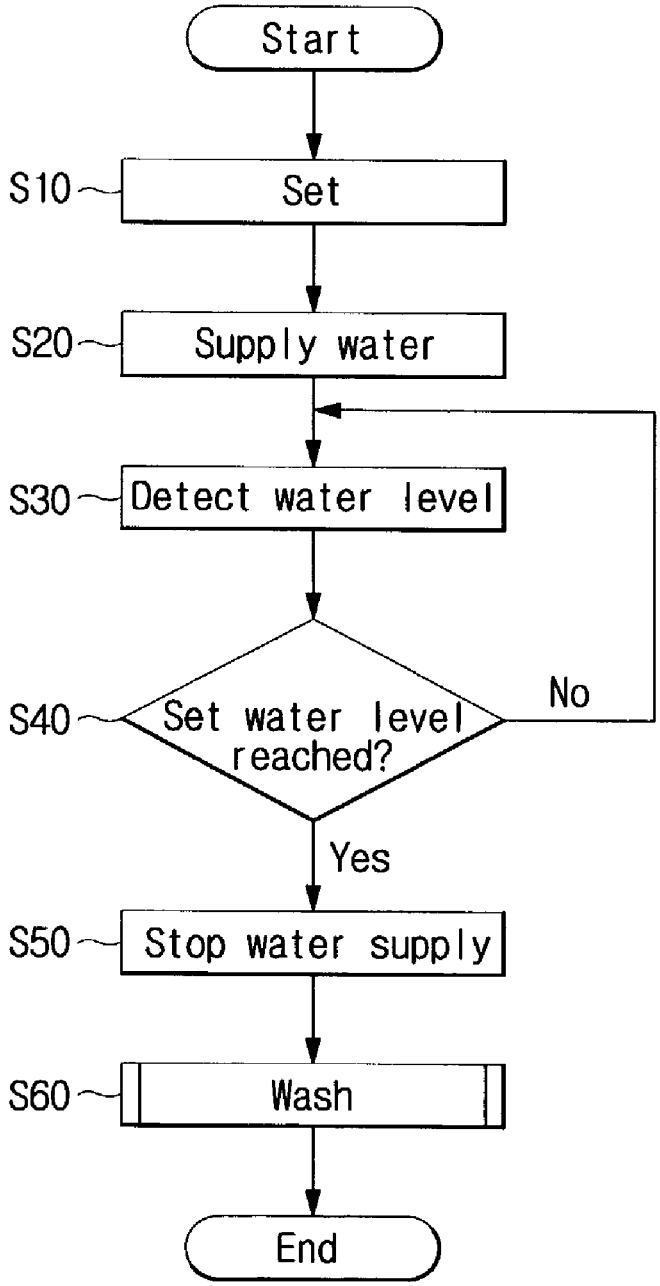
FIG. 1 is a flowchart showing a conventional method of controlling a washing machine.

Reference now should be made to the drawings, in which the same reference numerals are used throughout the different drawings to designate the same or similar components.

Figure 2A:
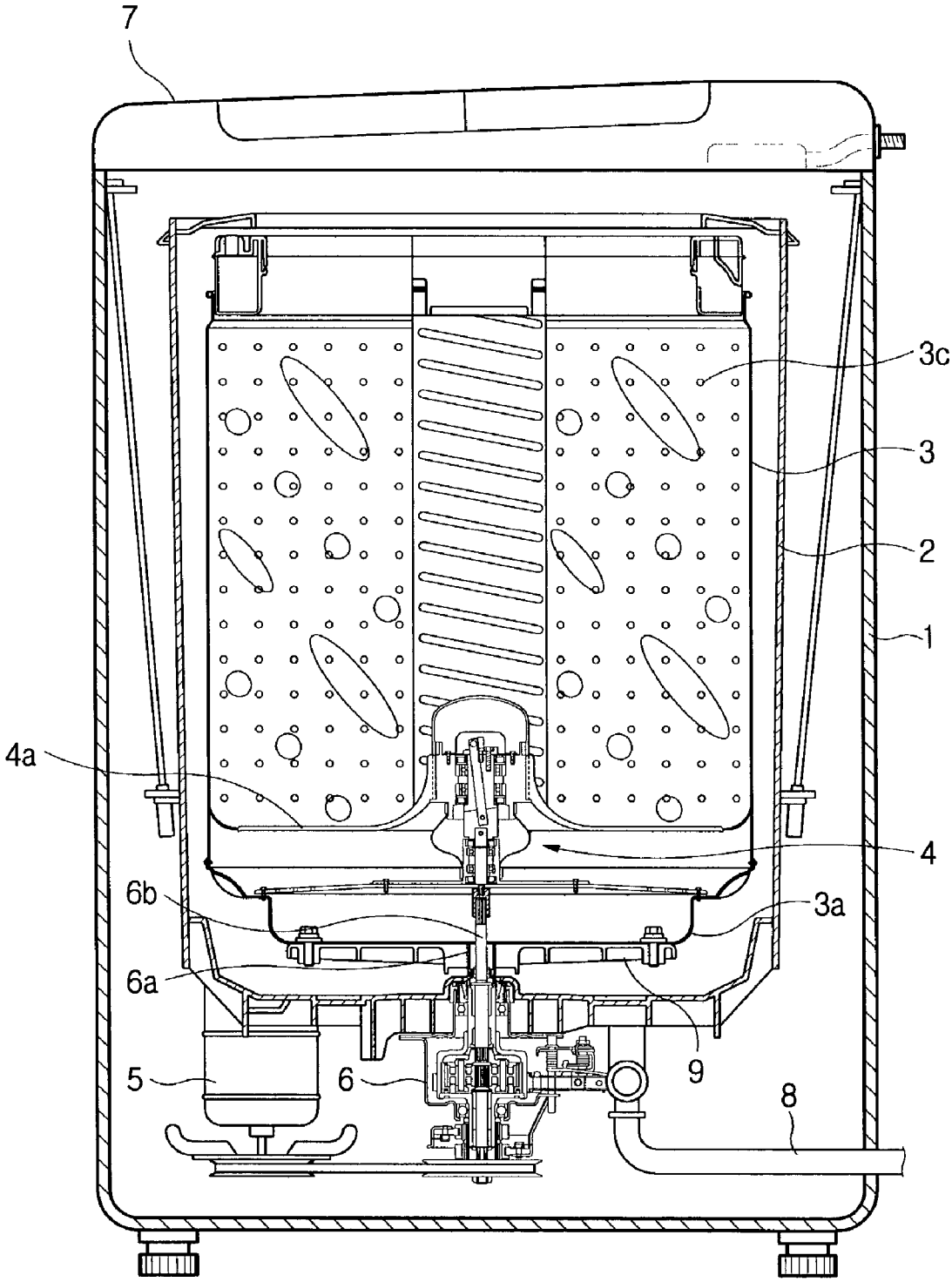
FIGS. 2*a* and 2*b* are sectional views of an illustrative embodiment of a washing machine with a wobbling device according to the principles of the present invention, showing the interior structure thereof, FIG. 2*a* illustrating the washing machine in which the wobbling device is switched to a leveling position so as to perform a spin-drying process, and FIG. 2*b* illustrating the washing machine in which the wobbling device is switched to a wobbling position so as to perform a washing process.
Figure 2B:
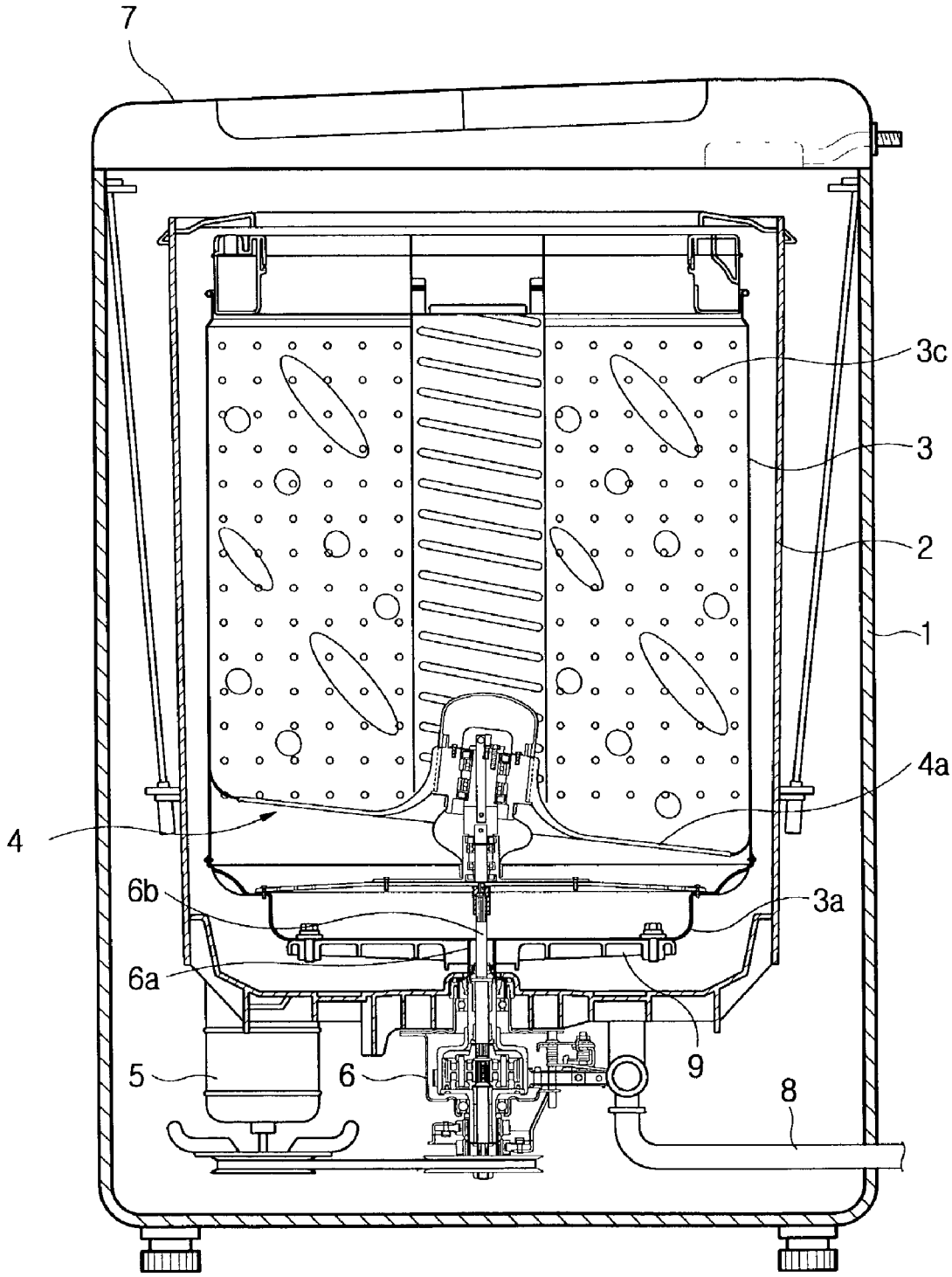

FIGS. 2*a* and 2*b* are longitudinal cross-sectional views showing the interior structure of a washing machine with a wobbling device 4, FIG. 2*a* illustrating the washing machine in which the wobbling device 4 is switched to a leveled position so as to perform a spin-drying process, FIG. 2*b* illustrating the washing machine in which the wobbling device is switched to a wobbling position so as to perform a washing process. The "leveled position" designates the position in which the wobbling device 4 allows a washboard 4*a* to be leveled horizontally and prevents a wobbling operation, while the "wobbling position" designates the position in which the wobbling device 4 allows the washboard 4*a* to be slanted and permits a wobbling motion of the washboard 4*a*.

Referring to FIGS. 2*a* and 2*b*, the washing machine in accordance with this exemplary embodiment of the present invention is comprised of an outer tub 2 mounted in a housing 1, a spin-drying tub 2 mounted in the outer tub 2 and provided with a plurality of spin-drying holes 3*c*, and a drive motor 5 and a power transmission device 6 positioned under the outer tub 2. Additionally, the wobbling device 4 is disposed in the lower portion of the spin-drying tub 3 to carry out a wobbling or leveling operation, in which the washboard 4*a* is slanted or leveled, respectively.

The top of the housing 1 is opened to allow the laundry to be put into and to be taken out from the housing 1. A door 7 is hingedly attached to the opened top of the housing 1 to selectively open and close the spin-drying tub 3.

A drain hose 8 is extended from the outer tub 2 to the outside so as to discharge washing water contained in the outer tub 2 to the outside after the washing of the laundry is completed.

A spin-drying shaft support 9 is mounted beneath a bottom plate 3*a* of the spin-drying tub 2 and a spin-drying shaft 6*a* of the power transmission device 6 is passed through the spin-drying shaft support 9, thus rotating the spin-drying tub 3 during a spin-drying process. A washing shaft 6*b* is passed through the spin-drying shaft 6*a*, with the upper end of the washing shaft 6*b* slightly extended from the upper end of the spin-drying shaft 6*a* so as to be coupled to the wobbling device 4.

The wobbling device 4 is mounted towards the bottom of the spin-drying tub 3, and serves to wash the laundry during the washing process by wobbling the laundry up and down in the wobbling position shown in FIG. 2*b*, and to spin-dry the laundry during a spin-drying process by rotating together with the spin-drying tub 3 in the leveling position shown in FIG. 2*a*.

Figure 3:
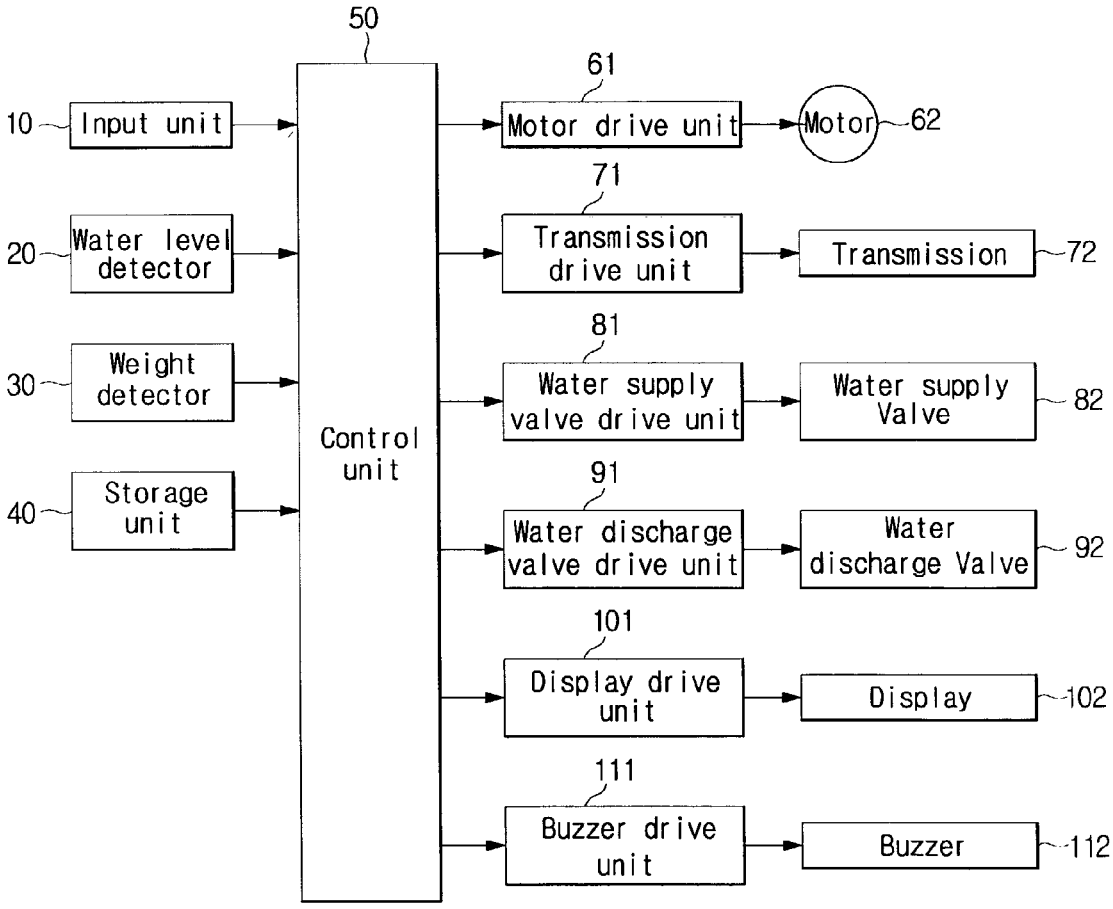
FIG. 3 is a block diagram of an exemplary embodiment of a washing machine control system in accordance with the principles of the present invention.

FIG. 3 is a block diagram of an exemplary embodiment of the washing machine according to the present invention.

Referring to FIG. 3, the washing machine includes a control unit 50 that controls the operation of the washing machine. An input unit 10 is electrically connected to the control unit 50 to receive information from a user. The input unit 10 is provided with, e.g., a plurality of keys that are used to set the washing conditions.

Additionally, a water level detector 20 for detecting the water level of the outer tub (not shown), a weight detector 30 for detecting the weight of the laundry, and a storage unit 40 for storing data are electrically connected to the control unit 50.

Additionally, a motor drive unit 61 for operating a motor 62, a transmission drive unit 71 for operating a transmission 72, a water supply valve drive unit 81 for operating a water supply valve 82, and a water discharge valve drive unit 91 for operating a water discharge valve 92 are electrically connected to the control unit 50.

Furthermore, a display drive unit 101 for operating a display 102 to display the operational states of the washing machine and a buzzer drive unit 111 for operating a buzzer 112 to audibly indicate the operational states of the washing machine are electrically connected to the control unit 50.

Figure 4:
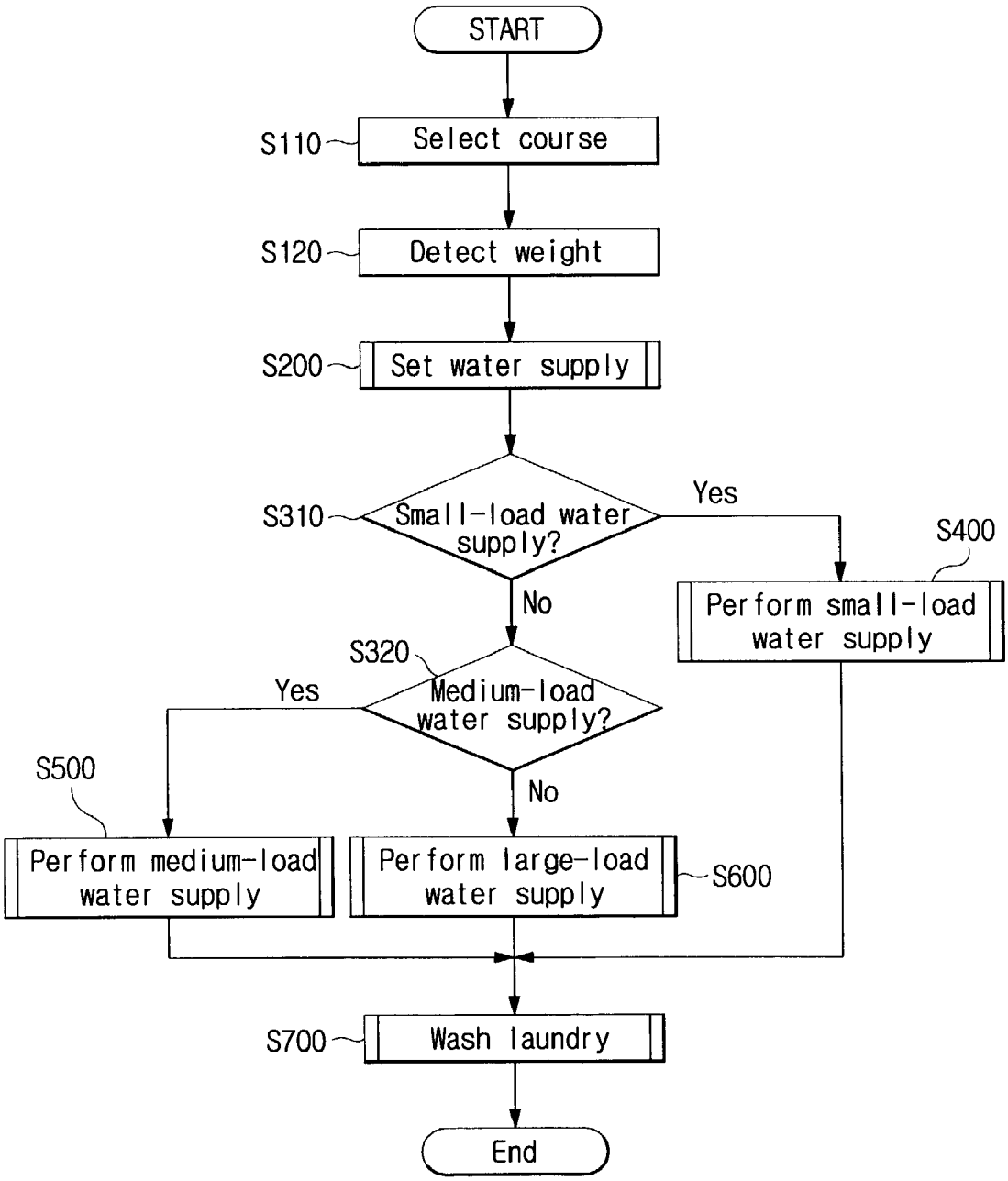
FIG. 4 is a flowchart showing an exemplary embodiment of a method of controlling the washing machine in accordance with the principles of the present invention.

FIG. 4 is a flowchart showing a method of controlling the washing machine in accordance with the present invention.

Referring to FIG. 4, a user selects a desired particular washing course or mode through the input unit 10 at step S110. Information inputted by the user through the input unit 10 is transmitted to the control unit 50.

The control unit 50 detects the weight of laundry through the weight detector 30 at step S120. Thereafter, the control unit 50 calculates the amount of laundry load corresponding to the detected weight of the laundry, and sets water supply conditions according to the amount of laundry load at step S200.

After water supply conditions are set at step S200, the control unit 50 determines whether small-load water supply is set at step S310. If the small-load water supply is set at step S310, the control unit 50 performs the small-load water supply at step S400 and the washing operation at step S700.

Meanwhile, if the small-load water supply is not set at step S310, the control unit 50 determines whether medium-load water supply is set at step S320. If the medium-load water supply is set at step S320, the control unit 50 performs the medium-load water supply at step S500 and the washing operation at step S700.

However, if the medium-load water supply is not set at step S320, the control unit 50 decides that large-load water supply is set and performs the large-load water supply at step S600, and, thereafter, performs the washing operation at step S700.

The water supply condition setting step S200 will now be described in more detail with references to FIG. 5.

Figure 5:
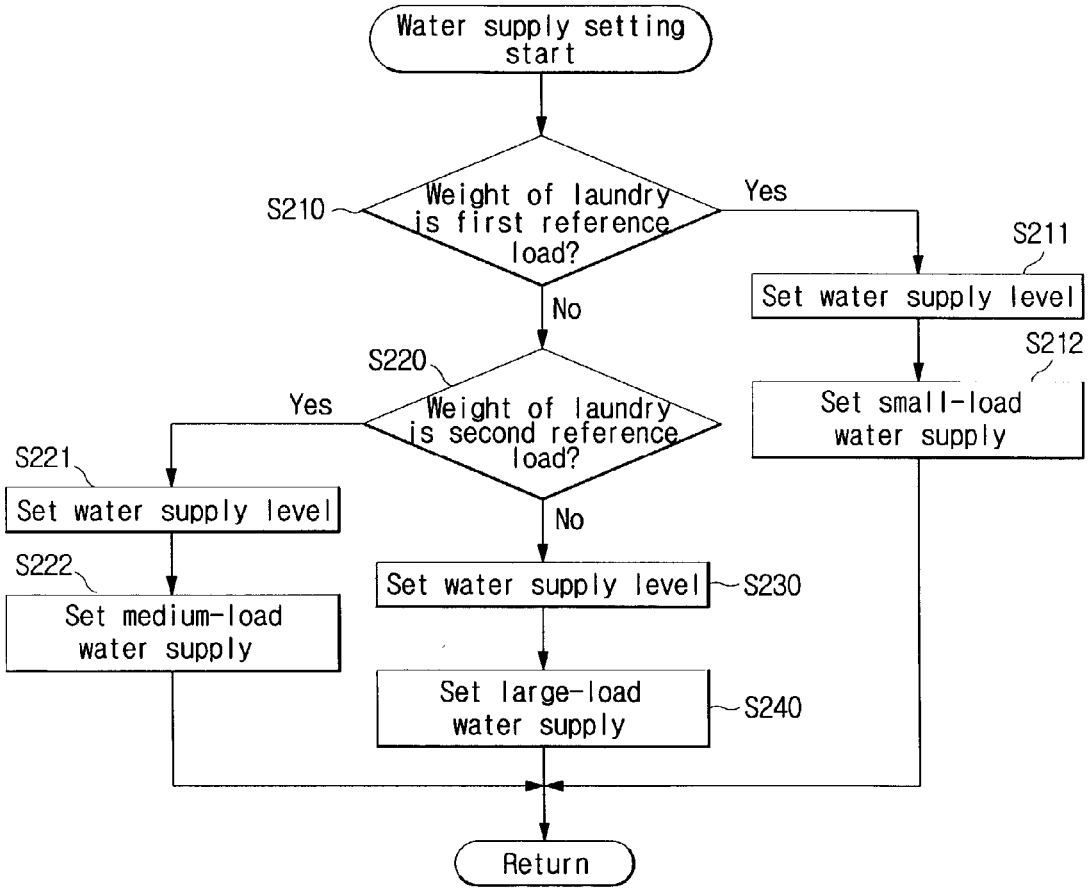
FIG. 5 is a detailed flowchart showing a water supply setting step of the method in accordance with the principles of the present invention shown in FIG. 4.

Referring to FIG. 5, the control unit 50 determines whether the weight of the laundry detected at step S120 (shown in FIG. 4) corresponds to a predetermined first reference load at step S210. In this exemplary embodiment, the first reference load may be, e.g., about 3 kg or less. If the weight of the laundry corresponds to the first reference load, that is, about 3 kg or less, at step S210, the control unit 50 sets a first total water supply level (the total amount of washing water to be supplied) according to the weight of the laundry. For example, if the weight of the laundry corresponds to the first reference load, the first total water supply level is set to about 30% of the maximum possible water supply level or less at step S211. Additionally, each water supply stage during the water supply is set to a small-load water supply stage at step S212.

In the small-load water supply stage, a primary water supply is performed to a basic water supply level (a water level lower than the first total water supply level, e.g., in this embodiment, ⅔ of the first total water supply level) through a predetermined number of sub-stages (for example, three sub-stages), and a secondary water supply is performed from the basic water supply level to the first total water supply level through a predetermined number of sub-stages (for example, two sub-stages).

Meanwhile, if the weight of the laundry does not correspond to the first reference load at step S210, the control unit 50 determines whether the weight of the laundry is less than a predetermined second reference load at step S220. If the weight of the laundry corresponds to the second reference load, that is, e.g.,6 kg, the control unit 50 sets a second total water supply level according to the weight of the laundry at step S221. If the weight of the laundry is heavier than the first reference load and lighter than the second reference load, the second total water supply level is set to 60% of the maximum possible water supply level or less. Additionally, each water supply stage during water supply is set to a medium-load water supply stage at step S222.

In the medium-load water supply stage, primary water supply is performed to a basic water supply level (a water level lower than the second total water supply level by a certain percentage; in this embodiment, ⅔ of the second total water supply level) through a predetermined number of sub-stages (for example, two sub-stages), and secondary water supply is performed from the basic water supply level to the second total water supply level through a predetermined number of sub-stages (for example, two sub-stages).

Meanwhile, if the weight of the laundry is greater than the second reference load at step S220, the control unit 50 sets a third total water supply level according to the weight of the laundry at step S230. If the weight of the laundry corresponds to the third reference load, the third total water supply level is set to 90% of the maximum possible water supply level or less. Additionally, each water supply stage during water supply is set to a large-load water supply stage at step S240.

In the large-load water supply stage, primary water supply is performed to a basic water supply level (a water level lower than the third total water supply level by a certain percentage, e.g., in this embodiment, ⅔ of the third total water supply level) continuously without sub-stages and secondary water supply is performed from the basic water supply level to the third total water supply level through a predetermined number of sub-stages (for example, two sub-stages).

Hereinafter, the small-load water supply step S400 is described in detail.

Figure 6A:
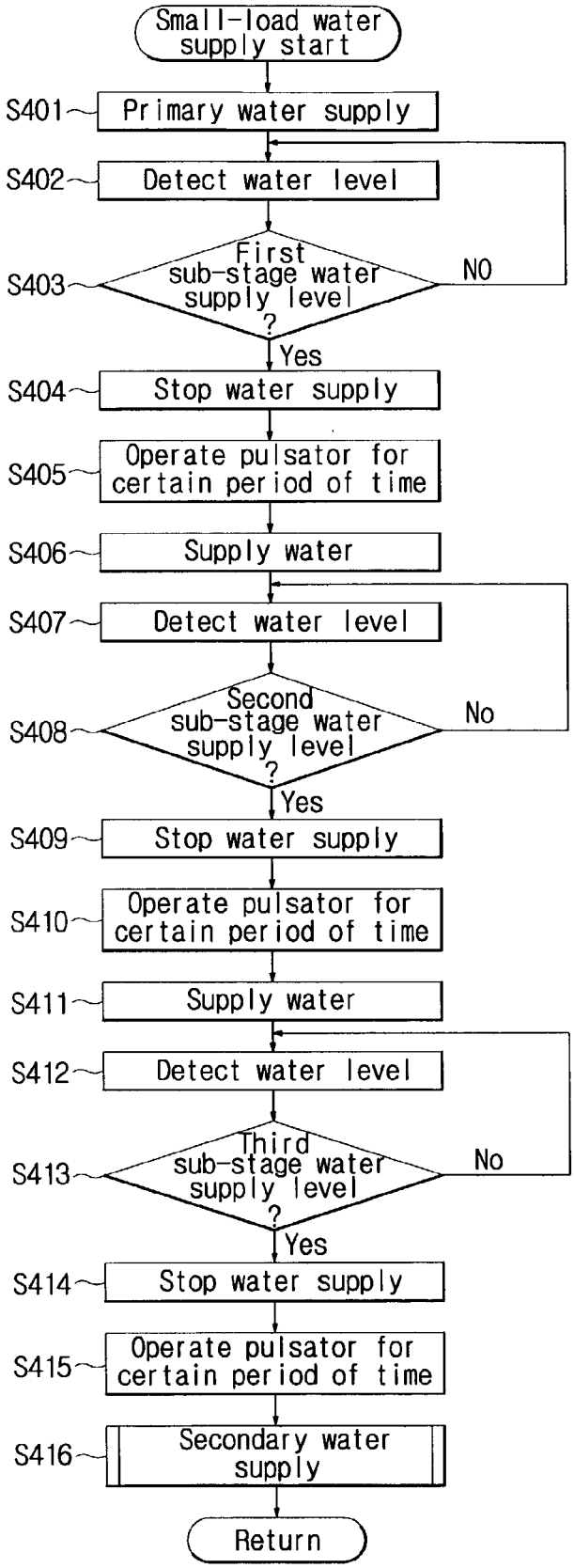
FIGS. 6*a* to 6*c* are flowcharts showing the water supply steps for the small, medium and large load, respectively, of the method in accordance with the present invention shown in FIG. 4.

FIG. 6*a* is a detailed flowchart showing an exemplary embodiment of the small-load water supply step S400 in accordance with the principles of the present invention. The small-load water supply includes primary water supply in which water is supplied to a basic water supply level and secondary water supply in which water is supplied from the basic water supply level to the first total water supply level. During the primary water supply, when water is supplied to a corresponding water supply level in each of the sub-stages (for example, first, second or third sub-stage water supply level). At each water supply sub-stage (for example, a total of three sub-stages), water supply is stopped, and the pulsator is operated for a predetermined period of time. This water supply pattern is applied to the secondary water supply as well.

Referring to FIG. 6*a*, the control unit 50 starts water supply by controlling the water supply valve drive unit 81 to open the water supply valve 82 at step S401. Additionally, the control unit 50 detects the water level of supplied water through the water level detector 20 at step S402. The control unit 50 determines whether the detected water level has reached the predetermined first sub-stage water supply level at step S403.

If the detected water level is the first sub-stage water supply level at step S403, the control unit 50 stops water supply by controlling the water supply valve drive unit 81 to close the water supply valve 82 at step S404. Additionally, the control unit 50 operates a pulsator (not shown) for a predetermined period of time by controlling the motor drive unit 61 to drive the motor 62 at step S405. Furthermore, the control unit 50 performs water supply by controlling the water supply valve drive unit 81 to open the water supply valve 82 at step S406.

The control unit 50 detects the level of supplied water through the water level detector 20 at step S407. The control unit 50 determines whether a detected water level has reached a predetermined first sub-stage water supply level at step S408.

If the detected water level is the second sub-stage water supply level at step S408, the control unit 50 stops water supply by controlling the water supply valve drive unit 81 to close the water supply valve 82 at step S409. Additionally, the control unit 50 operates the pulsator (not shown) for a predetermined period of time by controlling the motor drive unit 61 to drive the motor 62 at step S410. Furthermore, the control unit 50 performs water supply by controlling the water supply valve drive unit 81 to open the water supply valve 82 at step S411.

The control unit 50 detects the level of supplied water through the water level detector 20 at step S412. The control unit 50 determines whether a detected water level has reached a predetermined third sub-stage water supply level at step S413.

If the detected water level is the third sub-stage water supply level at step S413, the control unit 50 stops water supply by controlling the water supply valve drive unit 81 to close the water supply valve 82 at step S414. Additionally, the control unit 50 operates the pulsator (not shown) for a predetermined period of time by controlling the motor drive unit 61 to drive the motor 62 at step S415. Furthermore, the control unit 50 performs the secondary water supply to the first total water supply through a predetermined number of sub-stages (for example, two sub-stages) by controlling the water supply valve drive unit 81 to open the water supply valve 82 at step S416.

Hereinafter, the medium-load water supply step S500 is described in detail.

Figure 6B:
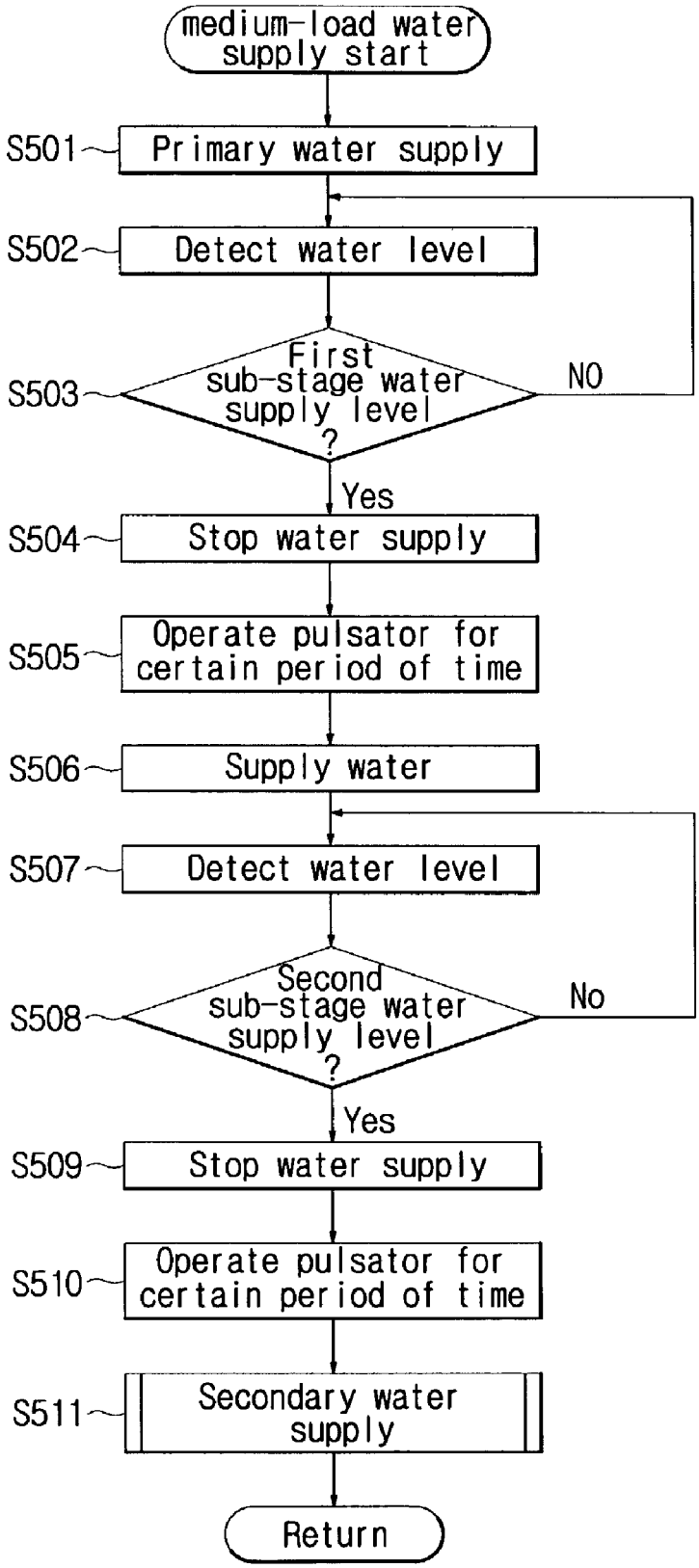

FIG. 6*b* is a detailed flowchart showing an exemplary embodiment of the medium-load water supply step S500 in accordance with the principles of the present invention. The medium-load water supply includes primary water supply in which water is supplied to a basic water supply level and secondary water supply in which water is supplied from the basic water supply level to the second total water supply level. During the primary water supply, when water is supplied to a corresponding water supply level in each of the sub-stages (for example, a first or second sub-stage water supply level). At each water supply sub-stage (for example, a total of two sub-stages), water supply is stopped, and the pulsator is operated for a predetermined period of time. This water supply pattern is also applied to the secondary water supply.

Referring to FIG. 6*b*, the control unit 50 starts water supply by controlling the water supply valve drive unit 81 to open the water supply valve 82 at step S501. Additionally, the control unit 50 detects the water level of supplied water through the water level detector 20 at step S502. The control unit 50 determines whether the detected water level has reached the predetermined first sub-stage water supply level at step S503.

If the detected water level is the first sub-stage water supply level at step S503, the control unit 50 stop water supply by controlling the water supply valve drive unit 81 to close the water supply valve 82 at step S504. Additionally, the control unit 50 operates the pulsator (not shown) for a predetermined period of time by controlling the motor drive unit 61 to drive the motor 62 at step S505. Furthermore, the control unit 50 supplies water by controlling the water supply valve drive unit 81 to open the water supply valve 82 at step S506.

The control unit 50 detects the level of supplied water through the water level detector 20 at step S507. The control unit 50 determines whether a detected water level has reached a predetermined second sub-stage water supply level at step S508.

If the detected water level is the second sub-stage water supply level at step S508, the control unit 50 stops water supply by controlling the water supply valve drive unit 81 to close the water supply valve 82 at step S509. Additionally, the control unit 50 operates the pulsator (not shown) for a predetermined period of time by controlling the motor drive unit 61 to drive the motor 62 at step S510. Furthermore, the control unit 50 performs the secondary water supply to the second total water supply through a predetermined number of sub-stages (for example, two sub-stages) by controlling the water supply valve drive unit 81 to open the water supply valve 82 at step S511.

Hereinafter, the large-load water supply step S600 is described in detail.

Figure 6C:
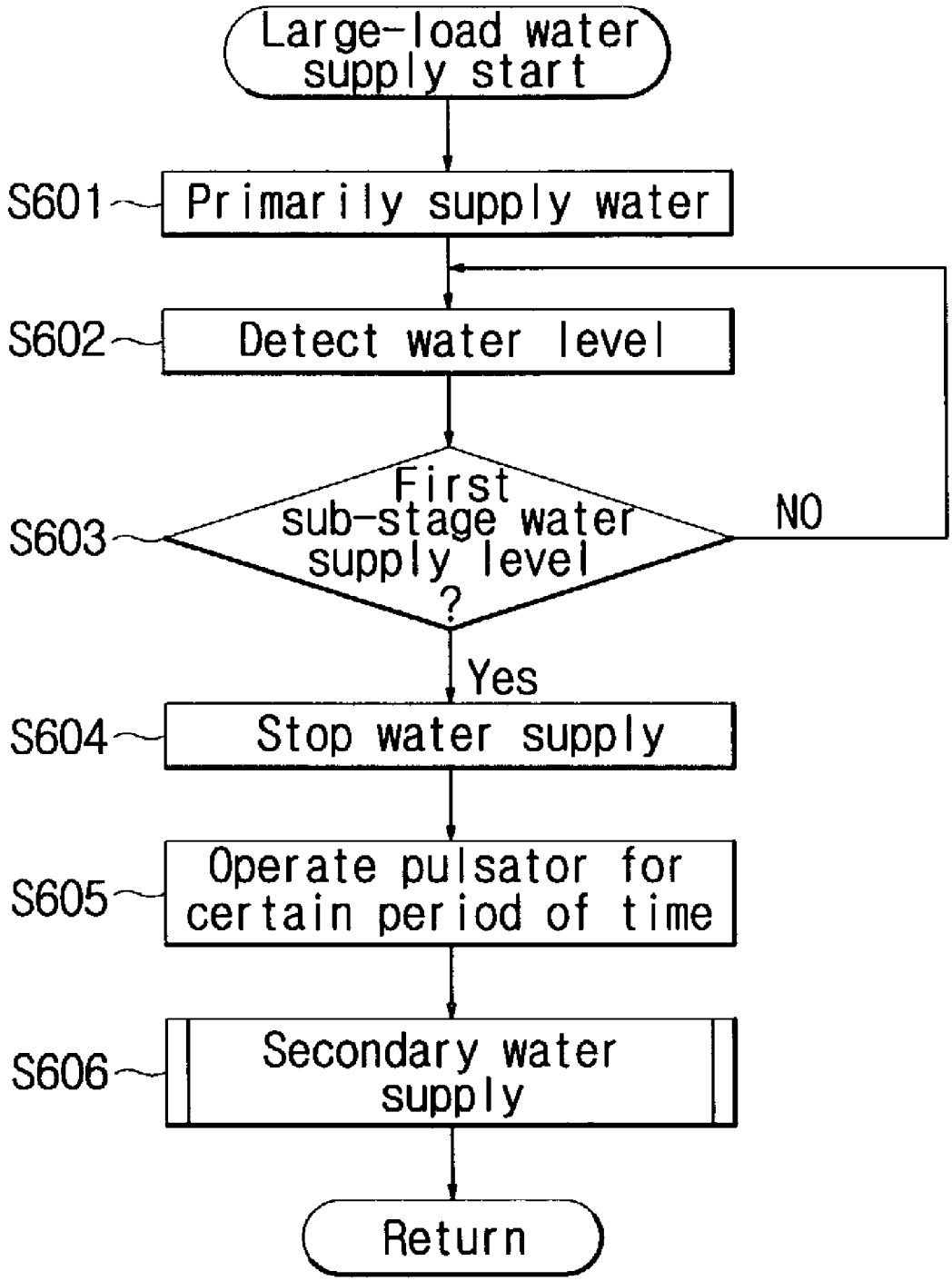

FIG. 6*c* is a detailed flowchart showing an exemplary embodiment of the large-load water supply step S600 in accordance with the principles of the present invention. The large-load water supply includes primary water supply in which water is supplied to a basic water supply level and secondary water supply in which water is supplied from the basic water supply level to the third total water supply level. In the primary water supply, water is supplied continuously without sub-stages, and the pulsator is operated for a predetermined period of time when the water supply is stopped after the basic water supply level has been reached. In the secondary water supply, water supply and the stopping of water supply are alternately performed through a predetermined number of sub-stages (for example, a total of two sub-stages).

Referring to FIG. 6*c*, the control unit 50 starts water supply by controlling the water supply valve drive unit 81 to open the water supply valve 82 at step S601. Additionally, the control unit 50 detects the water level of supplied water through the water level detector 20 at step S602. The control unit 50 determines whether the detected water level has reached the predetermined first sub-stage water supply level at step S603. The first sub-stage water supply level of the large-load water supply is identical to the basic water supply level. That is, in the large-load water supply, the primary water supply is performed in a single stage.

If the detected water level is determined to have reached the first sub-stage water supply level at step S603, the control unit 50 stops the water supply by controlling the water supply valve drive unit 81 to close the water supply valve 82 at step S604. Additionally, the control unit 50 operates the pulsator (not shown) for a predetermined period of time by controlling the motor drive unit 61 to drive the motor 62 at step S605.

The control unit 50 then performs the secondary water supply to the third total water supply through a predetermined number of sub-stages (for example, two sub-stages) by controlling the water supply valve drive unit 81 to open the water supply valve 82 at step S606.

As described above, the present invention provides the method of controlling a washing machine, in which load is set according to the weight of the laundry, and water is supplied through a plurality of stages according to the load, so the laundry is rapidly and uniformly wetted, thereby improving the washing performance of the washing machine and preventing the generation of noise and/or vibration.

Although the preferred embodiment of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of controlling a washing machine, comprising:

detecting a load of laundry;

determining a basic water supply level commensurate with said detected load;

supplying said basic water supply level through a plurality of stages, a corresponding apportionment of said basic water supply level being supplied during each respective ones of said plurality of stages; and comparing said detected load of laundry with a predetermined reference load, wherein said step of supplying said basic water supply level is performed in a single stage if said detected load of laundry is heavier than said predetermined reference load, and said step of supplying said basic water supply level is performed in said plurality of stages if said detected load of laundry is lighter than said predetermined reference load.

2. The method of controlling said washing machine in accordance with claim 1, further comprising:

operating a pulsator in at least one of said plurality of stages.

3. The method of controlling said washing machine in accordance with claim 2, wherein:

said operation of the pulsator is performed after said supply of said corresponding apportionment is completed.

4. The method of controlling said washing machine in accordance with claim 1, wherein:

said detected load of laundry is based on a weight of said laundry.

5. The method of controlling said washing machine in accordance with claim 1, wherein:

a number of stages of said plurality of stages increases as weight of said detected load of laundry decreases.

6. The method of controlling said washing machine in accordance with claim 1, wherein:

a number of stages of said plurality of stages decreases as weight of said detected load of laundry increases.

7. A method of controlling a washing machine comprising:

detecting a load of laundry;

determining a basic water supply level commensurate with said detected load;

supplying said basic water supply level through a plurality of stages, a corresponding apportionment of said basic water supply level being supplied during each respective ones of said plurality of stages;

comparing said detected load of laundry with a predetermined reference load, wherein said reference load is 90% of a washing capacity of said washing machine; and supplying said basic water supply level through the plurality of stages up to the predetermined reference load.

8. A method of controlling a washing machine having a wobbling device, a spin-drying tub and a washboard, said wobbling device being configured to be switched to a leveling position to operate said spin-drying tub, and said wobbling device being configured to be switched to a wobbling position to operate said washboard, said method comprising:

detecting a load of laundry;

determining a basic water supply level commensurate with said detected load; and supplying said basic water supply level through a plurality of stages, a corresponding apportionment of said basic water supply level being supplied during each respective ones of said plurality of stages, wherein said wobbling device is switched to said wobbling position during at least one of said plurality of stages.

9. The method of controlling said washing machine in accordance with claim 8, further comprising:

comparing said detected load of laundry with a predetermined reference load, wherein said step of supplying said basic water supply level is performed in a single stage if said detected load of laundry is heavier than said predetermined reference load, and said step of supplying said basic water supply level is performed in said plurality of stages if said detected load of laundry is lighter than said predetermined reference load.

10. The method of controlling said washing machine in accordance with claim 8, further comprising:

operating said wobbling device to cause said washboard to wobble in least one of said plurality of stages.

11. The method of controlling said washing machine in accordance with claim 10, wherein:

said operation of said wobbling device is performed after said supply of said corresponding apportionment is completed.

12. The method of controlling said washing machine in accordance with claim 8, wherein:

said detected load of laundry is based on a weight of said laundry.

13. The method of controlling said washing machine in accordance with claim 8, wherein:

said reference load is 90% of a washing capacity of said washing machine.

14. The method of controlling said washing machine in accordance with claim 8, wherein:

a number of stages of said plurality of stages increases as weight of said detected load of laundry decreases.

15. The method of controlling said washing machine in accordance with claim 8, wherein:

a number of stages of said plurality of stages decreases as weight of said detected load of laundry increases.

* * * * *